US005622069A

United States Patent [19]

Walters

[11] Patent Number: 5,622,069

[45] Date of Patent: Apr. 22, 1997

[54] STAMPING DIE WITH ATTACHED PLC

[75] Inventor: Harry J. Walters, Pittsburgh, Pa.

[73] Assignee: Oberg Industries, Inc., Freeport, Pa.

[21] Appl. No.: 613,353

[22] Filed: Mar. 11, 1996

[51] Int. Cl.[6] ..... B21D 37/00

[52] U.S. Cl. ..... 72/21.3; 72/20.2; 72/20.4; 72/30.1

[58] Field of Search ..... 72/16.1, 20.1, 72/20.2, 20.3, 20.4, 21.1, 21.2, 21.3, 30.1, 448

[56] References Cited

U.S. PATENT DOCUMENTS 4,211,098 7/1980 Luenser ..... 72/21.1
5,244,610 9/1993 Kitzmiller ..... 204/40.1
5,317,892 6/1994 Medici ..... 72/448
5,423,199 6/1995 Mangrulkar ..... 72/20.1

*Primary Examiner*—David Jones
*Assistant Examiner*—John Paradiso
*Attorney, Agent, or Firm*—Buchanan Ingersoll, P.C.

[57] ABSTRACT

A metal stamping die for a punch press is provided that has a programmable logic microcontroller fixed directly to the die body of the stamping die. The programmable logic microcontroller is encased in epoxy resin to protect it from contaminants and to protect it from vibration which will occur as the punch press operates to stamp metal parts. Sensing devices on the stamping die are electrically connected through passages in the stamping die to the programmable logic microcontroller. An annunciator panel is positioned on the programmable logic microcontroller and has light emitting diodes to indicate the type of malfunction in the die which causes the punch press to stop when a malfunction occurs.

12 Claims, 3 Drawing Sheets

STAMPING DIE WITH ATTACHED PLC

BACKGROUND OF THE INVENTION

1. Field of the Invention

This invention is directed to a stamping die for use in a punch press. The stamping die has a programmable logic microcontroller secured to the die body to receive and process signals from various sensing devices located on the die to sense die malfunctions when the punch press is in operation.

2. Description of the Prior Art

Metal stamping dies that are utilized in punch presses are commonly equipped with sensing devices such as switches, pressure sensitive devices and proximity devices. These sensing devices are used to detect malfunctions in the operation of the die as the punch press operates. Some typical malfunctions are strip misfed or misplacement, doubling of material thickness due to slugs being pulled on the punch, folding of the strip due to obstructions to the feed movement, part ejection failure, misposition of die components and other die failures which can occur as the punch press operates. The use of sensing devices on the die itself is well known.

It is also well known to use programmable logic controllers to monitor the state of the sensors and their relationship to the movement of this punch press and/or the strip of material being punched. The components of the die can also be monitored by the programmable logic controller for position and for integrity of the die. The stamped part can be monitored for desired features on the part. Forming forces can also be monitored.

Programmable logic controllers are commonly known, commercially available devices. For use on a punch press, they require additional packaging or housing in an enclosure to provide protection from fluids, dirt, and also require isolation from vibration. The isolation from vibration is usually accomplished by physically displacing the programmable logic controller away from the stamping press which is the source of vibration. Such positioning requires a connection from each sensor in the die to the programmable logic controller, resulting in a great number of wires that are vulnerable to damage and misconnection. An intermediate connection or junction box is sometimes utilized to alleviate long runs of individual wire connectors, but such an arrangement adds expense to the system.

I have found that a programmable logic microcontroller that is greatly reduced in size from the typical programmable logic controller can be mounted directly onto the die body of the stamping die. The components of the programmable logic microcontroller are encapsulated in an epoxy resin or other material or are enclosed in a hermetically sealed casing to keep fluid, dirt and vibration or other detrimental environmental factors from reaching the programmable logic microcontroller. With the programmable logic microcontroller fixed directly to the die body, wiring from the individual sensors to the programmable logic microcontroller is contained within the die itself and terminated at the die mounted microcontroller.

An annunciator panel including light emitting diodes and nomenclature describing the malfunctions sensed by each of the sensing devices is contained on the exterior face of the programmable logic microcontroller. When a sensing device indicates a malfunction of the die, a signal is sent to the programmable logic microcontroller on the die itself and that signal is transmitted to a power block within the punch press control enclosure. That signal then causes the punch press to stop.

SUMMARY OF THE INVENTION

In accordance with the present invention, there is provided a stamping die for use in a punch press which includes a die body and a programmable logic microcontroller secured to the die body.

Further in accordance with the present invention, there is provided a stamping die for use in a punch press which includes a die body. Sensing devices are positioned on the die body to detect malfunctions of the die when the punch press is in operation. A programmable logic microcontroller is secured to the die body. Connections are provided between each of the sensing devices and the programmable logic microcontroller to transmit signals from the sensing devices to the programmable logic microcontroller. Electrical connections from the programmable logic microcontroller to the punch press stop the punch press upon receipt by the programmable logic microcontroller of a die malfunction signal from one of the sensing devices.

Accordingly, an object of the present invention is to provide a programmable logic microcontroller attached directly to the die body of a punch press to receive signals from sensing devices in the die itself.

Another object of the present invention is to provide a programmable logic microcontroller which is encased in a protective epoxy resin to guard it against dirt, oil and vibration.

Another object of the present invention is to provide an annunciator panel on a programmable logic microcontroller to indicate the type of malfunction occurring in the die.

These and other objects of the present invention will become apparent as this description proceeds in conjunction with the following specification, the accompanying drawings and the appended claims.

DESCRIPTION OF THE PREFERRED EMBODIMENT

Figure 1:
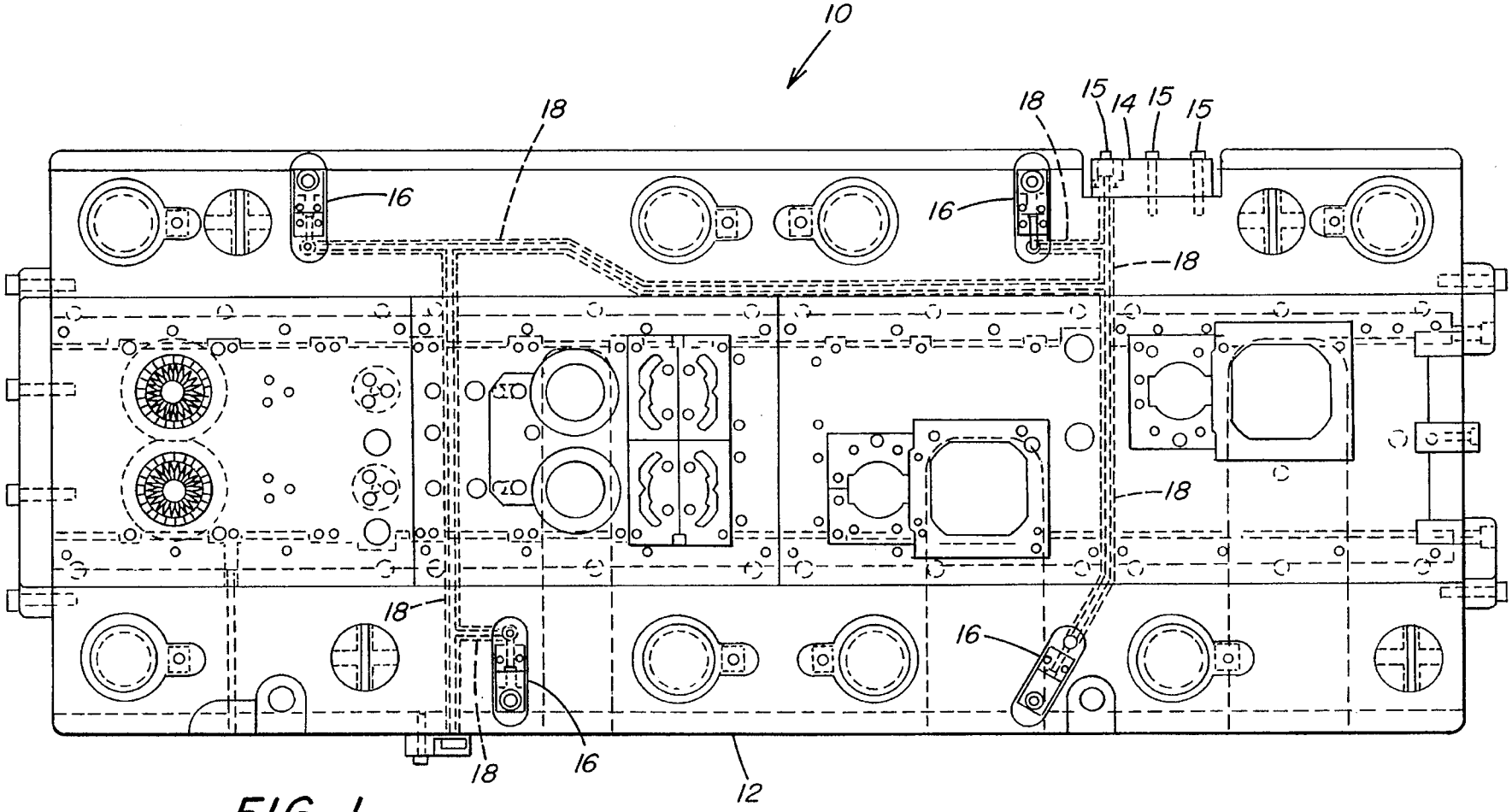
FIG. 1 is a top plan view of the stamping die body of the present invention.
Figure 2:
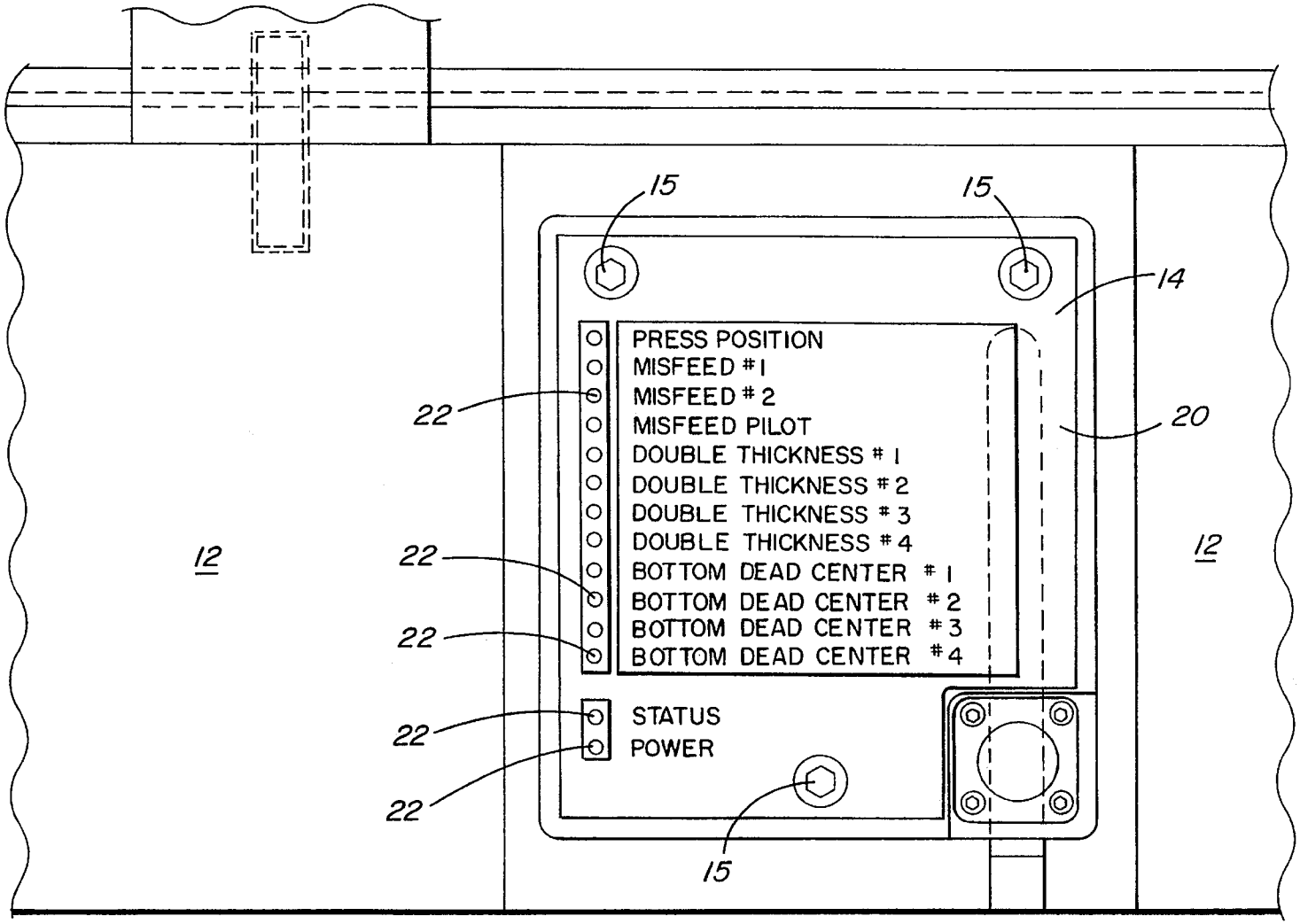
FIG. 2 is an elevation of a portion of the die body showing the programmable logic controller annunciator panel.

Referring to the drawings and particularly to FIGS. 1 and 2, there is shown a stamping die 10 having a die body 12. The stamping die 10 is of the type commonly used in punch presses to stamp parts from sheet metal. The exact configuration of the stamping die to produce a particular part forms no part of the present invention. In well known fashion, the stamping die body 12 contains recesses to receive mating punches that are forced downwardly through the strip of sheet metal into the recesses to either punch parts out of the sheet metal or to create desired voids in the sheet metal itself.

A programmable logic microcontroller 14 is secured to the die body 12 by bolts 15. The programmable logic microcontroller 14 is a commercially available 8 bit microcontroller purchased from Microchip Corporation and bearing part no. PIC 16C74-20/P-MD. Before being secured to die body 12, the programmable logic microcontroller 14 is encased in epoxy resin to protect the microcontroller 14 from grease, oil, dirt, grit, and other contaminants that may be present in the work place. The programmable logic microcontroller 14 is also protected from vibration by the epoxy resin that encases it.

As shown in FIG. 1, sensing devices 16 are strategically located on the die body 12. The sensing devices 16 may be switches, pressure sensitive devices, or proximity devices as required by the particular die. The position and type of sensing device 16 forms no part of the present invention other than to note that the sensing devices 16 are as commonly utilized on stamping dies. Electrical connections 18 are formed within the stamping die body 12 to connect each of the sensing devices 16 to the programmable logic microcontroller 14. The electrical connections 18 include passages, formed within the die body itself, containing electrical wires to transmit signals from the sensing devices 16 to the programmable logic microcontroller 14.

An annunciator panel 20 is positioned on the exposed external side of the programmable logic microcontroller 14. As shown in FIG. 2, the enunciator panel has a plurality of light emitting diodes 22 each of which are positioned next to nomenclature describing a particular malfunction which may be sensed by the sensing devices 16. When a particular sensing device 16 senses a malfunction, the microcontroller 14 causes the light emitting diodes next to the appropriate nomenclature to be activated, thereby indicating to the punch press operator what malfunction has occurred.

Figure 3:
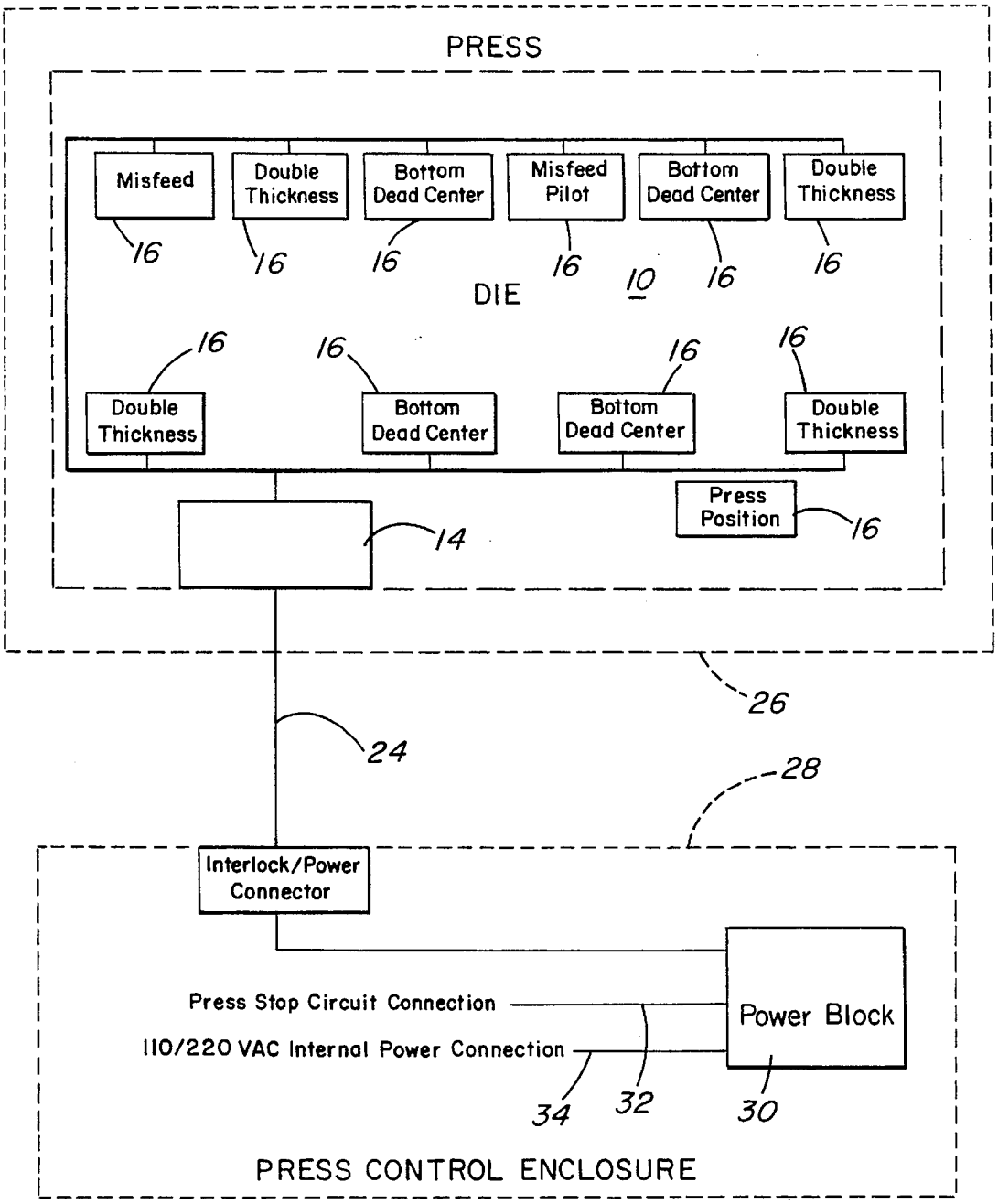
FIG. 3 is a block diagram of the stamping die of the present invention as located within the punch press and relative to the press control enclosure.

Referring to FIG. 3, there is shown a block diagram indicating schematically the components of the punch press and the press controlling enclosure which is the operator's station. As shown in FIG. 3, the stamping die 10 has the programmable logic microcontroller 14 affixed to it. The punch press 26 is indicated schematically around the stamping die 10. The various sensing devices 16 are labeled to show the possible malfunctions which sensing devices can detect. The sensing devices 16 shown in FIG. 3 are not located in any particular fashion but are indicated as being capable of location on the stamping die 10 as required for the particular part being manufactured.

As previously described, malfunction signals from the sensing devices 16 are received by the programmable logic microcontroller 14 that is affixed to the die 10. A power cable 24 includes electrical connections from the power block 30 located within the operator's station 28 at the press control enclosure to the programmable logic microcontroller 14. Power cable 24 includes a signal transmitting line which transmits information from the programmable logic microcontroller 14 to the power block within the operator's station 28 as well as a power line which transmits electrical power to the microcontroller 14.

A punch press stop connection 32 transmits a signal to the punch press to stop the punch press upon receipt of a malfunction signal from programmable logic microcontroller 14. The input power connection 34 brings power into the power block 30 and power is transmitted to the programmable logic microcontroller 14 through power cable 24.

It may be seen that by placing the programmable logic microcontroller 14 directly on the die, there is a great savings in wiring of the sensor 16 to the programmable logic microcontroller 14. In the prior art, the programmable logic microcontroller was located in the press control enclosure or operator's station 28. The advantages of the present invention are clearly apparent. There is a reduced wiring requirement. The programmable logic microcontroller may be preprogrammed for operational use before it is encased in the epoxy resin so that there is a permanently programmed logic microcontroller preprogrammed for operational use. The ability to program the programmable logic microcontroller can also survive after the microcontroller is encased in epoxy to permit modification of the program. The programmable logic microcontroller is die mounted with a self-contained annunciator panel. The programmable logic microcontroller is vibration resistant, fluid resistant, protected against contaminants, and is provided at a reduced cost from prior art controllers utilized for the same purpose.

According to the provisions of the patent statutes, I have explained the principle, preferred construction and mode of operation of my invention and have illustrated and described what I now consider to represent its best embodiment. However, it should be understood that, within the scope of the appended claims, the invention may be practiced otherwise than as specifically illustrated and described.

I claim:

1. A stamping die for use in a punch press comprising:

a die body;

sensing devices positioned on said die body to detect malfunctions of said die when said punch press is in operation;

a programmable logic microcontroller secured to said die body;

connections between each of said sensing devices and said programmable logic microcontroller to transmit signals from said sensing devices to said programmable logic microcontroller; and electrical connections from said programmable logic microcontroller to said punch press to stop said punch press upon receipt by said programmable logic microcontroller of a die malfunction signal from one of said sensing devices.

2. The stamping die of claim 1 wherein said programmable logic microcontroller is pre-programmed before being secured to said die body.

3. The stamping die of claim 1 wherein said programmable logic microcontroller is embedded in epoxy resin before being secured to said die body.

4. The stamping die of claim 1 wherein said connections between said sensing devices and said programmable logic microcontroller are electrical connections located within said die body.

5. The stamping die of claim 1 wherein said programmable logic microcontroller has an annunciator panel including light emitting diodes positioned on an exterior surface of said programmable logic microcontroller to indicate the nature of any malfunction.

6. The stamping die of claim 1 wherein electrical connections are provided to supply power to said programmable logic microcontroller.

7. The stamping die of claim 1 wherein said sensing devices are pressure sensitive.

8. The stamping die of claim 1 wherein said sensing devices are sensitive to unusual movement.

9. A stamping die for use in a punch press comprising:

a die body;

sensing devices positioned on said die body to detect malfunctions of said die when said punch press is in operation;

a programmable logic microcontroller having an annunciator panel with light emitting diodes as part of said microcontroller; said microcontroller being embedded in epoxy resin with said light emitting diodes being visible and said microcontroller being pre-programmed before being embedded in said epoxy resin;

said programmable logic microcontroller being secured to said die body;

electrical connections located within said die body between each of said sensing devices and said programmable logic microcontroller to transmit signals from said sensing devices to said programmable logic microcontroller when a malfunction occurs during operation of said punch press;

first electrical connections to supply power to said programmable logic microcontroller; and second electrical connections from said programmable logic microcontroller to said punch press to stop said punch press upon receipt by said programmable logic microcontroller of a die malfunction signal from one of said sensing devices.

10. The stamping die of claim 9 wherein said sensing devices are pressure sensitive.

11. The stamping die of claim 9 wherein said sensing devices are sensitive to unusual movement.

12. The stamping die of claim 9 wherein said first and second electrical connections are located within a single power cable.

* * * * *